US010189676B2

(12) United States Patent
Hovi et al.

(10) Patent No.: US 10,189,676 B2
(45) Date of Patent: Jan. 29, 2019

(54) APPARATUS FOR PERFORMING A RESCUE RUN IN AN ELEVATOR SYSTEM BY SELECTING RESCUE FUNCTIONS TO UTILIZE TO PERFORM THE RESCUE RUN AND A METHOD OF PERFORMING SAME

(71) Applicants: Antti Hovi, Hyvinkaa (FI); Ari Kattainen, Hyvinkaa (FI); Ari Ketonen, Helsinki (FI)

(72) Inventors: Antti Hovi, Hyvinkaa (FI); Ari Kattainen, Hyvinkaa (FI); Ari Ketonen, Helsinki (FI)

(73) Assignee: Kone Corporation, Helsinki (FI)

( * ) Notice: Subject to any disclaimer, the term of this patent is extended or adjusted under 35 U.S.C. 154(b) by 488 days.

(21) Appl. No.: 14/944,816

(22) Filed: Nov. 18, 2015

(65) Prior Publication Data

US 2016/0068368 A1 Mar. 10, 2016

Related U.S. Application Data

(63) Continuation of application No. PCT/FI2014/050401, filed on May 23, 2014.

(30) Foreign Application Priority Data

May 29, 2013 (FI) ..... 20135589

(51) Int. Cl.
*B66B 1/34* (2006.01)
*B66B 5/02* (2006.01)
*B66B 1/06* (2006.01)

(52) U.S. Cl.
CPC ..... *B66B 1/343* (2013.01); *B66B 1/06* (2013.01); *B66B 5/027* (2013.01)

(58) Field of Classification Search
CPC ..... B66B 1/343; B66B 1/06; B66B 5/027
(Continued)

(56) References Cited

U.S. PATENT DOCUMENTS 3,902,573 A 9/1975 Grove et al.
6,196,355 B1 * 3/2001 Fargo ..... B66B 3/00 187/287

(Continued)

FOREIGN PATENT DOCUMENTS

EP 1314679 A1 5/2003
EP 2347982 A1 7/2011

(Continued)

OTHER PUBLICATIONS

International Search Report PCT/ISA/210 for International Application No. PCT/FI2014/050401 dated Sep. 16, 2014.

(Continued)

*Primary Examiner* — Anthony Salata
(74) *Attorney, Agent, or Firm* — Harness, Dickey & Pierce, P.L.C.

(57) ABSTRACT

The invention relates to a method and to an apparatus for performing a rescue run with an elevator. In the method information is received from the sensors measuring the operation of the elevator about the points being measured with the sensors in question, one or more rescue run functions are selected on the basis of information received from the sensors, and also a rescue run, including the selected one or more rescue run functions, is performed.

24 Claims, 2 Drawing Sheets

(58) Field of Classification Search
USPC ..... 187/247, 380–388, 391–393, 288, 290, 187/313, 316
See application file for complete search history.

(56) References Cited

U.S. PATENT DOCUMENTS

| | | | | |
|---|---|---|---|---|
| 6,264,005 | B1 * | 7/2001 | Kang | B66B 5/027 187/290 |
| 6,364,066 | B1 * | 4/2002 | Bolch | B66B 5/0018 187/391 |
| 7,434,664 | B2 * | 10/2008 | Helstrom | B66B 1/32 187/306 |
| 7,448,473 | B2 * | 11/2008 | Lindberg | B66B 1/34 187/384 |
| 7,549,515 | B2 * | 6/2009 | Tegtmeier | B66B 5/027 187/288 |
| 7,617,911 | B2 | 11/2009 | Mattila et al. | |
| 7,681,693 | B2 * | 3/2010 | Tegtmeier | B66B 1/30 187/288 |
| 7,690,483 | B2 * | 4/2010 | Tegtmeier | B66B 5/027 187/290 |
| 8,230,978 | B2 * | 7/2012 | Agirman | B66B 5/027 187/290 |
| 8,316,996 | B2 * | 11/2012 | Hashimoto | B66B 5/027 187/281 |
| 8,960,371 | B2 * | 2/2015 | Schoenauer | B66B 5/027 187/290 |
| 2009/0133965 | A1 | 5/2009 | Mattila et al. | |
| 2012/0085593 | A1 | 4/2012 | Schoenauer et al. | |

FOREIGN PATENT DOCUMENTS

| | | | |
|---|---|---|---|
| GB | 1469576 | A | 4/1977 |
| JP | 2000-247558 | A | 9/2000 |
| JP | 2004-142842 | A | 5/2004 |
| JP | 2012-056694 | A | 3/2012 |
| WO | WO-99/50165 | A1 | 10/1999 |
| WO | WO-2007/099198 | A1 | 9/2007 |
| WO | WO-2010018298 | A1 | 2/2010 |

OTHER PUBLICATIONS

Written Opinion of the International Searching Authority PCT/ISA/237 for International Application No. PCT/FI2014/050401 dated Sep. 16, 2014.

Finish Search Report for Application No. 20135589 dated Oct. 30, 2013.

* cited by examiner

APPARATUS FOR PERFORMING A RESCUE RUN IN AN ELEVATOR SYSTEM BY SELECTING RESCUE FUNCTIONS TO UTILIZE TO PERFORM THE RESCUE RUN AND A METHOD OF PERFORMING SAME

This application is a continuation of PCT International Application No. PCT/FI2014/050401 which has an International filing date of May 23, 2014, and which claims priority to Finnish patent application number 20135589 filed May 29, 2013, the entire contents of both of which are incorporated herein by reference.

FIELD OF THE INVENTION

The invention relates to solutions for performing a rescue run with an elevator.

BACKGROUND OF THE INVENTION

A run of an elevator car might be interrupted owing to a functional nonconformance in such a way that the elevator car becomes jammed at a point outside the exit floor, at which point the elevator passengers are not able the leave the elevator car. A functional nonconformance might be caused e.g. by an electricity outage or control error.

Information about an elevator car becoming jammed outside the exit floor is usually sent to a service center for the elevators and then onwards to a serviceman, who visits the site to free the passengers stuck in the elevator car.

Freeing the passengers takes place by performing a rescue run from outside the elevator hoistway by opening the mechanical brakes of the hoisting machine from a manual opening handle. After the brakes have been opened the traction sheave of the hoisting machine is able to rotate, in which case the elevator car starts to move from the effect of gravity. If electric power is available from the main supply of the elevator and the electric drive of the elevator is operational, the serviceman can also drive the elevator car at low speed with the hoisting machine from outside the elevator hoistway from a manual user interface equipped for this purpose. The run takes place by depressing and holding down the drive switch in the manual user interface. The serviceman monitors the progress of the elevator car either via direct visual contact or from a separate speed display, and engages the mechanical brakes/releases the drive switch when the elevator car arrives at an exit floor, when the elevator car stops.

AIM OF THE INVENTION

The aim of the invention is to disclose a solution for improving the safety of a rescue run. This aim can be achieved with a method and with an apparatus according to example embodiments.

One aim of the invention is to disclose a solution by means of which the elevator car also stops at a point on the exit landing that is more precisely correct than prior art. This aim can be achieved with a method and with an apparatus example embodiments.

The preferred embodiments of the invention are described in the dependent claims. Some inventive embodiments and inventive combinations of the various embodiments are also presented in the descriptive section and in the drawings of the present application.

SUMMARY OF THE INVENTION

One aspect of the invention is a method for performing a rescue run with an elevator. In the method information is received from the sensors measuring the operation of the elevator about the points being measured with the sensors in question, one or more rescue run functions are selected on the basis of information received from the sensors and also a rescue run, including the selected one or more rescue run functions, is performed.

A second aspect of the invention is an apparatus for performing a rescue run, comprising an elevator car, an electrically operated hoisting machine, with which the elevator car is driven, one or more electromagnetic machinery brakes, and a brake controller, which is configured to open the machinery brake(s) by supplying current to the electromagnets of the machinery brake(s), and also to apply the machinery brake(s) to brake the hoisting machine by disconnecting the current supply of the electromagnets. The apparatus further comprises a reserve power drive for supplying electric power to the aforementioned one or more machinery brakes during an electricity outage of the elevator, a drive unit, with which the movement of the elevator is controlled by supplying electric power from the main supply of the elevator to the hoisting machine, sensors measuring the operation of the elevator, and also an electronic safety controller, which is connected to the aforementioned sensors measuring the operation of the elevator for receiving information about the points being measured with the sensors in question. The electronic safety controller comprises a processor and also a memory, in which a program to be executed by the processor has been recorded. The electronic safety controller comprises at least one safety output, which is connected to the drive unit and is configured to disconnect the current supply from the main supply of the elevator to the hoisting machine, and which safety output is further connected to a brake controller and is configured to disconnect the current supply to the electromagnets of the aforementioned one or more machinery brakes.

This means that a rescue run can be planned in advance with the plan taking into account the information to be received about the points being measured with the sensors. In this case the rescue run can also be executed in a controlled manner without endangering the safety of elevator passengers. The solution is an improvement with respect to known art because the drive does not need to be performed just manually under the supervision of a serviceman. In some embodiments a rescue run is started by remote control from a service center for elevators. By means of the information to be received from the sensors measuring the operation of the elevator, it can be monitored that the rescue run proceeds in the manner desired, and the rescue run can still be interrupted if the measured operation of the elevator differs from that desired.

A rescue run means an operation with which an elevator car is safely returned to an exit floor when normal operation has been interrupted and the elevator has stopped, or is stopping, outside the exit floor. In this context a rescue run is understood to comprise a plurality of different rescue run functions, which can also vary from one rescue run to another. It is also possible that not all the rescue run functions are used in connection with each rescue run. Possible rescue run functions are described in more detail in connection with the description of preferred embodiments of the invention below.

In a preferred embodiment of the invention the aforementioned sensors comprise a safety contact and/or a series circuit of safety contacts. In one preferred embodiment of the invention the sensors comprise one or more of the following: a safety contact of a car door, a safety contact of a landing door, a final limit switch of the elevator hoistway, a switch bounding a temporary servicing space in the elevator hoistway, a safety contact of the overspeed governor, a safety contact of the safety gear of the elevator car.

In a preferred embodiment of the invention one or more opened safety contacts are bypassed for the duration of the rescue run on the basis of information received from the sensors. In this case a rescue run can travel to a point monitored with a safety contact, or via a point monitored with a safety contact, that is bypassed even though the aforementioned safety contact itself would indicate that the safety of the monitored point has been endangered.

In a preferred embodiment of the invention the rescue run is monitored by means of those safety contacts that are not bypassed. In this case the rescue run can be performed under the supervision of the aforementioned safety contacts that are not bypassed.

In a preferred embodiment of the invention a malfunction of the elevator relating to a bypassed safety contact is recorded in non-volatile memory and also, on the basis of the aforementioned malfunction of the elevator recorded in non-volatile memory, a run with the elevator is prevented after the rescue run has been performed. This means that when the safety criteria are met, a rescue run can be performed and passengers can be freed from the elevator car, even though the detected malfunction in question would itself require that the elevator be taken out of use.

In a preferred embodiment of the invention the aforementioned malfunction recorded in non-volatile memory is reset from a manual user interface of the elevator. This means that a run with the elevator is allowed again after a serviceman has first visited the elevator to reset the aforementioned malfunction and at the same time has checked the safety of the elevator.

In a preferred embodiment of the invention the presence of an object in a door opening of the elevator hoistway is monitored with one or more sensors, and the safety contact of the opened landing door is bypassed for the duration of the rescue run, if the door opening of the elevator hoistway is free. This means that the elevator car can be driven in connection with a rescue run to the aforementioned door opening, or via the aforementioned door opening, without danger of a person or other object being crushed in the space between the door opening of the elevator hoistway and the elevator car.

In a preferred embodiment of the invention the presence of an object in the door opening of the car door is monitored with one or more sensors, and also the safety contact of the opened car door is bypassed for the duration of the rescue run, if the door opening of the car door is free. This means that the elevator car can be driven in connection with a rescue run without danger of a person or other object being crushed in the space between the door opening of the elevator hoistway and the elevator car.

In one preferred embodiment of the invention the aforementioned sensors comprise a camera. By means of a camera, e.g. the presence of an object in an entrance of the elevator hoistway can be monitored.

In one preferred embodiment of the invention the aforementioned sensors comprise a light curtain. By means of a light curtain, e.g. the presence of an object in the door opening of the elevator car and/or in the door openings of the elevator hoistway can be monitored. In some embodiments by means of a light curtain the movement of an object on a landing is monitored, more particularly by estimating the possibility of the object moving into the door opening of the elevator hoistway.

In one preferred embodiment of the invention the drive direction of the elevator car is selected on the basis of information received from the sensors. In some embodiments it is monitored that a rescue run of an elevator car that has arrived at a final limit switch is directed away from the end of the elevator hoistway. In some embodiments it is monitored that a rescue run of the elevator car is directed away from a point, the safety of which point, on the basis of information received from the sensors measuring the point, has been endangered.

In one preferred embodiment of the invention a run is started, on the basis of the information received from the sensors, for driving the elevator car with the elevator motor according to the speed reference to an exit floor. This means that the elevator car can be positioned with automatic control according to the speed reference at the exit floor, in which case the elevator car can also be made to stop extremely accurately at the exit floor, and consequently a step is not left between the exit landing and the elevator car, which step might make leaving the elevator car difficult.

In one preferred embodiment of the invention a run is started for driving the elevator car by means of gravity to the exit floor, if a run in the direction of travel brought about by gravity is possible on the basis of the information received from the sensors. Consequently the elevator car can be driven to the exit floor despite the electricity outage/failure of the electric drive, utilizing gravity.

An electronic safety controller refers in the invention to a programmable electronic safety device, which is designed to fulfill a set safety integrity level, most preferably Safety Integrity Level SIL 3 according to standard EN IEC 61508.

In one preferred embodiment of the invention an electronic safety controller comprises two safety outputs controllable independently of each other, the first of which is connected to the drive unit and is configured to disconnect the current supply from the main supply of the elevator to the hoisting machine, and which first safety output is further connected to a brake controller and is configured to disconnect the current supply from the main supply of the elevator to the electromagnets of the aforementioned one or more machinery brakes. The second safety output is connected to a brake controller and is configured to disconnect the current supply from the reserve power drive to the electromagnets of the aforementioned one or more machinery brakes. This means that with the elevator a rescue run can be performed under the supervision of the electronic safety controller both when the main supply is energized and also during an electricity outage.

In one preferred embodiment of the invention the electronic safety controller is configured determine the operating state of the elevator on the basis of information received from the sensors measuring the operation of the elevator. In some embodiments the electronic safety controller is configured to select one or more of the rescue run functions on the basis of information received from the sensors, and to form a control command for performing the type of rescue run that comprises one or more functions selected on the basis of information received from the sensors.

In one preferred embodiment of the invention the electronic safety controller is configured to receive information during rescue run from one or more sensors measuring the operation of the elevator, and also to interrupt the rescue run if the measured operation of the elevator differs from that desired.

In a preferred embodiment of the invention the electronic safety controller is configured to bypass in the software of the safety controller one or more opened safety contacts on the basis of information received from the sensors. Consequently the bypassing can be done automatically without a serviceman needing to visit the elevator to bridge the aforementioned safety contact.

In a preferred embodiment of the invention the electronic safety controller is configured to monitor a rescue run by means of those safety contacts that are not bypassed. In this case the rescue run can be performed under the supervision of the electronic safety controller and by means of the aforementioned safety contacts that are not bypassed.

In a preferred embodiment of the invention the electronic safety controller is configured to record in the non-volatile memory of the safety controller a malfunction of the elevator relating to a bypassed safety contact and also to prevent, on the basis of the aforementioned malfunction of the elevator recorded in non-volatile memory, a run with the elevator after the rescue run has been performed. This means that when the special safety criteria recorded in the memory of the safety controller are met, a rescue run can be performed and passengers can be freed from the elevator car, even though the detected malfunction in question would itself require that the elevator be taken out of use.

In a preferred embodiment of the invention the safety controller is configured to reset a malfunction recorded in non-volatile memory on the basis of a reset request received from a manual user interface of the elevator. This means that a run with the elevator is allowed again after a serviceman has first visited the elevator to reset the aforementioned malfunction and at the same time has checked the safety of the elevator.

In one preferred embodiment of the invention the electronic safety controller is configured to monitor with one or more sensors the presence of an object in a door opening of the elevator hoistway and also to bypass in the software of the safety controller for the duration of the rescue run the safety contact of the opened landing door, if the door opening of the elevator hoistway is free.

In one preferred embodiment of the invention the electronic safety controller is configured to monitor with one or more sensors the presence of an object in a door opening of the car door, and also to bypass in the software of the safety controller for the duration of the rescue run the safety contact of the opened car door, if the door opening of the car door is free.

In a preferred embodiment of the invention the electronic safety controller is configured to select the drive direction of the elevator car on the basis of information received from the sensors and also to monitor that the rescue run heads in the intended drive direction.

In one preferred embodiment of the invention the apparatus comprises an elevator control unit for forming a speed reference for the elevator car, and the safety controller of the elevator is configured to form, on the basis of the information received from the sensors, a control command for driving the elevator car with the elevator motor according to the speed reference to an exit floor, and also to send the control command formed to the elevator control unit.

In one preferred embodiment of the invention the electronic safety controller is configured to form, on the basis of information received from the sensors, a control command for driving the elevator car by means of gravity to an exit floor.

A third aspect of the invention relates to a method for monitoring the safety of a rescue run of an elevator. In the method information is received from the sensors measuring the operation of the elevator about the points being measured with the sensors in question, and the rescue run is interrupted if, on the basis of the information to be received from the sensors, it is detected during the rescue run that the elevator car would be traveling to a point in which safety has been endangered. This means that the rescue run does not need to be interrupted if a safety contact opens at a point that is situated outside the rescue run route.

The preceding summary, as well as the additional features and additional advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

Figure 1:
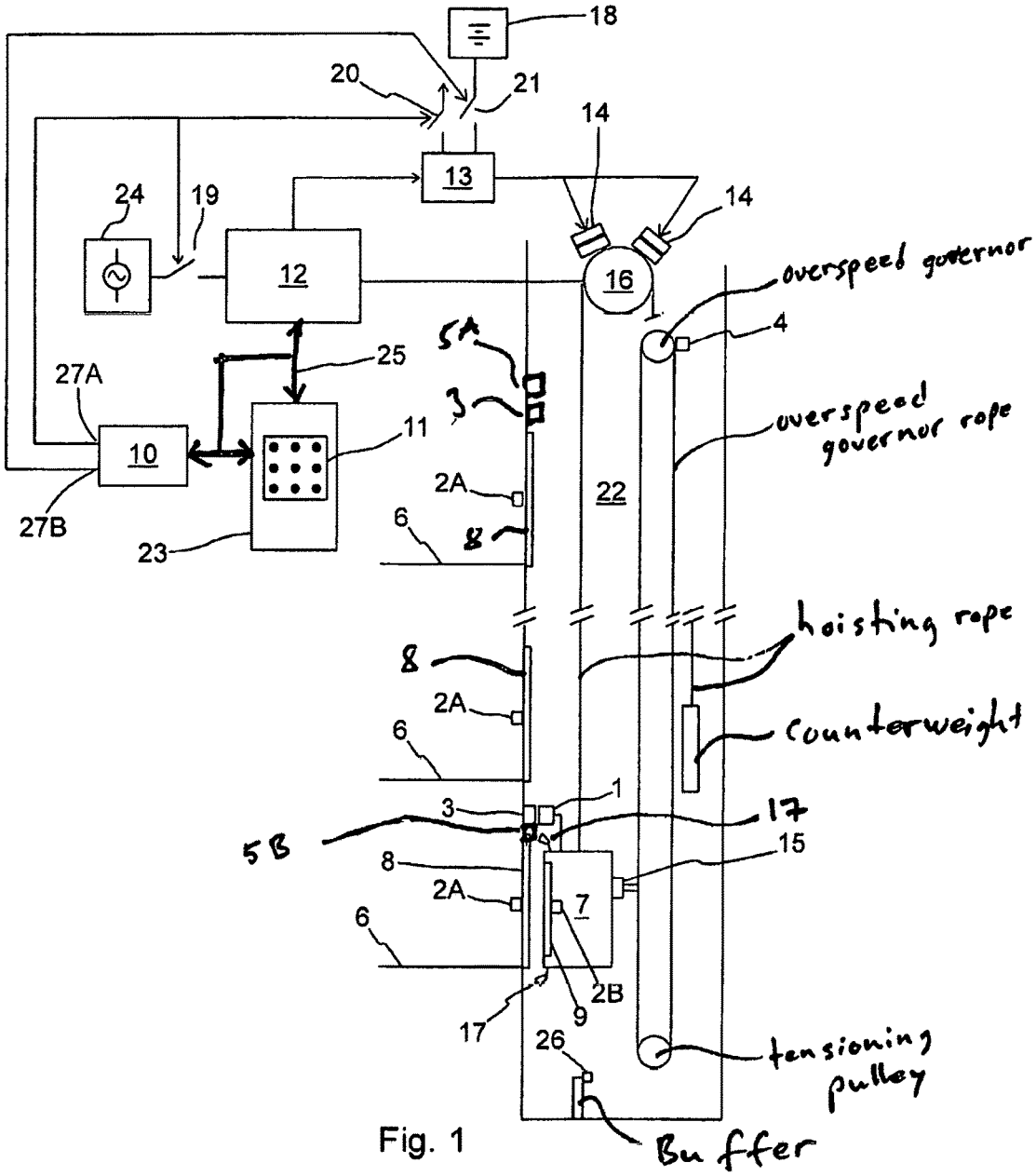
FIG. 1 presents as a block diagram an elevator according to an embodiment of the invention.

FIG. 1 presents an elevator, in which the elevator car 7 is driven in the elevator hoistway 22 with an electric drive by means of rope traction. The speed of the elevator car 7 is adjusted to be according to the speed reference of the elevator car, i.e. the target value for the movement of the elevator car, calculated by the elevator control unit 23. The speed reference is formed in such a way that the passengers can be transferred with the elevator car 7 from one floor to another on the basis of elevator calls given by elevator passengers. The electric drive comprises a hoisting machine 16, which comprises a traction sheave, with which the elevator ropes and consequently the elevator car is pulled, a permanent-magnet synchronous motor with which the elevator car is driven by rotating the traction sheave, generally two mechanical brakes 14 with which the traction sheave is braked and also a frequency converter 12, with which the hoisting machine is driven by steplessly controlling the power flow between the permanent-magnet synchronous motor and the main supply 24 of the elevator. The brakes 14 are opened by supplying current to the electromagnet of the brake with the brake controller 13. Instead of a permanent-magnet synchronous motor, also another applicable electric motor could be used in the hoisting machine, such as a squirrel-cage motor, a reluctance motor or a direct current motor.

The elevator comprises permanently-magnetized actuators 3, which are fitted beside the path of movement of the elevator car 7 in the elevator hoistway 22 and which are read contactlessly with a door zone sensor 1 moving along with the elevator car 7. The door zone sensor 1 comprises Hall sensors fitted consecutively in the direction of the path of movement of the elevator car, with which Hall sensors the aforementioned permanently-magnetized actuators 3 are read when the door zone sensor 1 is located beside an actuator 3 in the elevator hoistway. With the door zone sensor 1, inter alia, the actuator 3 determining the location of the elevator car in the door zone is read, as well as the actuator 5A indicating the location of the elevator car at the extreme limit of permitted movement of the elevator car in the top end and the actuator 5B indicating the location of the elevator car at the extreme limit of permitted movement of the elevator car in the bottom end. Alternatively, monitoring off the top end limit and bottom end limit could be performed with mechanical positive-opening controllable safety contacts 5A, 5B, which open when the elevator car 7 arrives at the safety contact. Hereinafter the general designation "final limit switch" will be used to refer to the actuators 5A, 5B. A door zone of an elevator car means an area of approx. 20-30 centimeters in the vertical direction in the environment of an exit landing 6. The floor of an elevator car 7 situated at the center point of a door zone is situated at exactly the same height as exit landing 6, in which case elevator passengers are able to conveniently pass between the exit landing 6 and the elevator car 7. The solutions described in international patent application no. WO 2010/018298 A1, for example, can be used as a door sensor 1/actuators 3, 5A, 5B.

The elevator comprises an electronic safety controller 10, which is connected to the door zone sensor 1, an elevator control unit 23 and also a frequency converter 12 via a safety bus 25 with Safety Integrity Level SIL 3 safety classification. The electronic safety controller 10 is a programmable electronic safety device, which is designed to fulfill the Safety Integrity Level SIL 3 according to standard EN IEC 61508.

The elevator also has mechanical positive-opening safety contacts 2A of a landing door, which safety contacts are fitted to the different floors of the building to measure the position of the landing doors 8 of the elevator hoistway. In an elevator car 7 is at least one safety contact 2B, which is configured to measure the position of the automatic door 9 of the elevator car. Other safety contacts belonging to the elevator are e.g. a safety contact 4 of the overspeed governor fitted in connection with the rope pulley of the overspeed governor, a safety contact 5 of the safety gear fitted in connection with the safety gear of the elevator car, and a safety contact 26 of the end buffer measuring the operation of the end buffer of the elevator hoistway. The aforementioned safety contacts 2A, 2B, 4, 5, 26 are all wired to the electronic safety controller 10, either directly or by connecting two or more safety contacts in series with each other.

The electronic safety controller 10 monitors the safety of the elevator system by means of the aforementioned safety contacts/sensors 1, 2A, 2B, 4, 5, 25. When a safety contact opens, the safety controller 10 interrupts the run by disconnecting the electricity supply to the permanent-magnet synchronous motor with the contactor 19 and by disconnecting the electricity supply to the machinery brakes 14 with the contactor 20.

The elevator of FIG. 1 comprises a reserve power device 18, comprising an accumulator, from where electric power is optionally supplied to the brakes 14 and also to the electronic safety controller 10 and to at least some of the safety contacts/sensors 1, 2A, 2B, 4, 5, 26 during an electricity outage of the main supply 24 of the elevator. The safety controller of the elevator comprises two safety outputs controllable independently of each other, the first 27A of which is connected to the control coils of the contactors 19 and 20, for disconnecting the electricity supply occurring from the main supply 24 to the hoisting machine 16 and also to the machinery brakes 14, and the second 27B is connected to the control coil of the contactor 21, for disconnecting the electricity supply occurring from the reserve power device 18 to the machinery brakes 14. The machinery brakes 14 are opened by closing the contactor 21.

A run of the elevator car 7 might be interrupted owing to a functional nonconformance in such a way that the elevator car 7 becomes jammed at a point outside an exit floor 6, at which point the elevator passengers in the elevator car 7 are not able the leave the elevator car 7. A functional nonconformance might be caused e.g. by an electricity outage occurring in the main supply 24 of the elevator, or by an operating error or failure of the electric drive of the elevator. For this reason the elevator installation of FIG. 1 is configured to perform a rescue run in which the elevator car 7 is safely returned to an exit floor 6 when normal operation of the elevator has been interrupted, and the elevator car 7 has stopped, or is stopping, outside the exit floor.

The electronic safety controller 10 comprises a processor and also a non-volatile memory, in which are recorded the rescue run functions to be controlled with the processor. The electronic safety controller 10 selects the rescue run functions to be performed at any given time on the basis of the information received from the safety contacts/sensors 1, 2A, 2B, 4, 5, 26.

The electronic safety controller 10 is also configured to receive information from the safety contacts/sensors 1, 2A, 2B, 4, 5, 26 during the rescue run and also to interrupt the rescue run if the information received from the safety contacts/sensors 1, 2A, 2B, 4, 5, 26 about the operation of the elevator differs from that desired. A rescue run is interrupted by disconnecting the electricity supply to the permanent-magnet synchronous motor and also to the electromagnets of the machinery brakes 14.

With the apparatus according to FIG. 1, a rescue run can be performed both when the main supply 24 is energized and also during an electricity outage that has occurred in the main supply. A flow chart 21 of a rescue run, together with the various rescue run functions, is presented in more detail in connection with FIG. 2.

Figure 2:
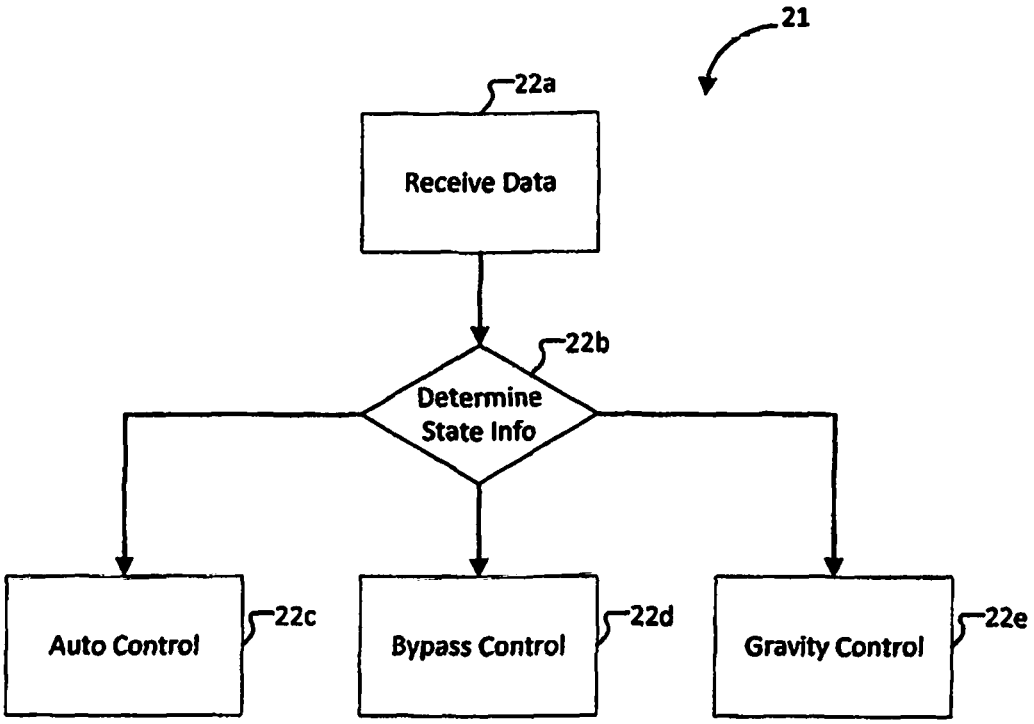
FIG. 2 presents as a flow chart a run plan according to an embodiment of the invention.

In phase 22*a* in FIG. 2 the electronic safety controller 10 receives from the elevator control unit 23 information that a run of the elevator car has been interrupted owing to a functional nonconformance and that the elevator car is stuck outside the exit floor 6 in such a way that elevator passengers are not able to exit the elevator car.

After this, in phase 22*b*, the safety controller 10 determines the state of the main supply 24 of the elevator and also reads from the safety contacts 2A, 2B, 4, 5, 26 as well as from the door zone sensor 1 information about the points measured with the safety contacts/sensor 1, 2A, 2B, 4, 5, 26.

If the main supply 24 is energized and if the safety contacts/door zone sensor 1, 2A, 2B, 4, 5, 26 do not prevent movement of the elevator car 7, the run plan shifts to phase 22*c*, in which the safety controller 10 controls the contactors 19 and 20 closed and sends to the elevator control unit 23 a control command for driving the elevator car 7 with automatic control to the nearest exit floor 6. The hoisting machine 16 drives the elevator car to the exit floor 6 at a low correction drive speed according to the speed reference formed by the elevator control unit 23, after which the elevator car is stopped and passengers exit the elevator car.

If the safety contacts/sensor 1, 2A, 2B, 4, 5, 26 indicate that the safety of the elevator has become endangered, the run plan shifts to phase 22*d*. If the safety contact 2A of a landing door is open, the safety contact in question is bypassed in the software of the safety controller so that the rescue run can be performed. The safety controller 10 forms for the elevator control unit 23 a control command for driving the elevator car 7 at a low correction drive speed to the nearest possible exit floor 6 using a route that does not travel via a space monitored with an opened safety contact. If, on the other hand, the door zone sensor 1 indicates that the elevator car 7 has arrived at a final limit switch 5A, 5B, the final limit switch 5A, 5B is bypassed in the software of the safety controller 10 and the safety controller 10 forms for the elevator control unit 23 a control command for driving the elevator car 7 to an exit floor 6 away from the end of the elevator hoistway.

If an electricity outage has occurred in the main supply 24, the run plan shifts to phase 22*e*. The safety controller 10 closes the contactor 21, in which case the brakes 14 open. If there is in this case a sufficient weight difference on the different sides of the traction sheave, the elevator car 7 starts moving from the effect of gravity. The safety controller 10 receives information about the movement direction of the elevator car 7 from the door zone sensor 1. If the movement of the elevator car is directed, via a zone determined as safe, directly to an exit floor, or if the movement of an elevator car 7 on the final limit switch 5A, 5B is directed away from the end, the safety controller 10 allows continuation of the movement of the elevator car to the exit floor 6. When the elevator car arrives at the exit floor 6 the safety controller 10 opens the contactor 21, in which case the brakes 14 engage, the elevator car stops and the passengers are able to exit the elevator car. If the movement of the elevator car would travel via an area determined as dangerous, the safety controller 10 opens the contactor 21 and sends information about failure of the run to the service center.

If a dangerous situation detected in phase 22*d* or 22*e* requires that the elevator is removed from use, information about the removal from use is recorded in the non-volatile memory of the safety controller 10. A dangerous situation requiring this type of removal from use of an elevator is e.g. the arrival of the elevator car at a final limit switch 5A, 5B, opening of the safety contact 26 of the final limit buffer, opening of the safety contact 4 of the overspeed governor, or opening of the safety contact 15 of the safety gear of the elevator car. In this case the aforementioned safety contact is bypassed for the duration of the rescue run so that the rescue run can be performed. The safety controller 10, however, on the basis of the malfunction of the elevator recorded in memory, prevents a run with the elevator after the rescue run has been performed. In this case a rescue run can be performed and passengers can be freed from the elevator car 7 without endangering safety even though the malfunction itself in fact requires removal of the elevator from use. Returning the elevator into use again requires that a serviceman on a visit to the elevator resets the malfunction from a manual user interface 11 of the elevator control unit 23.

The safety controller 10 also receives the speed data of the elevator car during the rescue run from the door zone sensor 1 and interrupts the run if the speed of the elevator car increases to be too high. Speed data can be obtained e.g. from an acceleration sensor connected to the door zone sensor 1. In another embodiment the safety controller 10 reads the safety contact 4 of the overspeed governor and interrupts a run when the safety contact 4 of the overspeed governor opens as a consequence of overspeed.

The safety controller 10 interrupts the rescue run if the safety controller 10 detects during the rescue run that the elevator car 7 would be traveling to a point in which safety has been endangered, e.g. on the basis of the opening of a safety contact 2A, 2B, 4, 5, 26 or otherwise.

When the elevator car 7 moves under the effect of gravity, the speed of the elevator car is limited by connecting the stator windings of the permanent-magnet synchronous motor into a short-circuit, in which case the stator currents brought about by the rotating rotor brake the elevator car 7.

In a second embodiment of the invention the reserve power device 18 is also equipped to supply alternating current from a battery to the stator windings of the permanent-magnet synchronous motor. In this case the elevator car 7 can be driven with the permanent-magnet synchronous motor to an exit floor also in a situation in which the weight difference on the different sides of the traction sheave is too small to bring about movement of the elevator car.

In a third embodiment of the invention the elevator car is provided with cameras 17 according to FIG. 1, with which the presence of an object in the door opening of the elevator hoistway is monitored. The safety controller 10 bypasses for the duration of the rescue run the safety contact of an opened landing door if a camera 17 indicates that the door opening monitored with the aforementioned safety contact is free.

In a fourth embodiment of the invention the elevator car 7 is provided with a light curtain, the measuring beam of which is directed to measure the presence of an object in the door opening of the elevator car. The safety controller 10 bypasses for the duration of the rescue run the safety contact of the opened car door if the light curtain indicates that the door opening of the car door is free.

In a fifth embodiment of the invention, if the elevator car has stopped between floors, and if the safety contact 4 of the overspeed governor is open but the safety contact 15 of the safety gear is closed, (this means that the safety gear has not gripped the elevator car even though the safety contact 4 of the overspeed governor has opened), the safety controller 10 allows the run at a low correction drive speed downwards to the nearest exit floor 6 After arriving at the exit floor 6 the safety controller 10 connects the machinery brakes 14 and also checks from the door zone sensors 1 that the elevator is sufficiently precisely at the floor, after which the doors are opened and the elevator is removed from use in the manner described above.

In a sixth embodiment of the invention, when an elevator car 7 that has left the door zone with door open has been stopped between floors with the machinery brakes 14, the safety controller 10 allows the opening of the machinery brakes 14 and a run at a low correction drive speed back to the exit floor 6 after the safety contact 2B of the car door as well as also the safety contact 2A of the landing door of the exit floor 6 are closed (a closed safety contact 2A, 2B also indicates that the car door/landing door in question is closed). In this case the run starts after a call-giving device, either in the elevator car or on the exit floor 6, has been pressed. After arriving at the exit floor 6 the safety controller 10 connects the machinery brakes 14 and checks from the door zone sensors 1 that the elevator is sufficiently precisely at the floor, after which the doors are opened and the elevator is removed from use in the manner described above.

The electronic safety controller 10 described above comprised two safety outputs 27A, 27B. The invention can also be implemented, however, with a safety controller 10 having only one safety output 27A, 27B. In this case with the same output 27A, 27B of the safety controller, the electricity supply to the electric motor/machinery brakes 14 of the hoisting machine is disconnected, both when the main supply 24 of the elevator is energized and also during an electricity outage.

The invention is described above by the aid of a few examples of its embodiment. It is obvious to the person skilled in the art that the invention is not limited to the embodiments described above, but that many other applications are possible within the scope of the inventive concept defined by the claims presented below.

LIST OF REFERENCE NUMBERS USED

1 door zone sensor
2A safety contact of landing door 2B safety contact of car door
3 actuator of door zone sensor
4 safety contact of overspeed governor
5A final limit switch in top end of elevator hoistway
5B final limit switch in bottom end of elevator hoistway
6 exit landing
7 elevator car
8 landing door
9 door of elevator car
10 electronic safety controller
11 manual user interface, comprising rescue run buttons
12 frequency converter
13 brake controller
14 machinery brake
15 safety contact of safety gear
16 hoisting machine
17 camera
18 reserve power device
19 brake switch
20 brake switch, reserve power drive
21 run plan
22 elevator hoistway
23 elevator control unit
24 main supply of elevator
25 safety bus
26 safety contact of end limit buffer
27A first safety output
27B second safety output

The invention claimed is:

1. A method for performing a rescue run, the method comprising:
receiving information from sensors measuring an operation of an elevator about points being measured with the sensors;
reading, from a non-volatile memory device, rescue run functions that are selectable to perform the rescue run;
automatically selecting one or more of the rescue run functions based on information received from the sensors; and
performing the rescue run including the selected one or more rescue run functions.

2. The method according to claim 1, further comprising:
receiving information during the rescue run from one or more sensors measuring the operation of the elevator; and
interrupting the rescue run if the measured operation of the elevator differs from that desired.

3. The method according to claim 1, wherein the sensors include one or more safety contacts and/or a series circuit of the one or more safety contacts.

4. The method according to claim 3, further comprising:
bypassing the one or more safety contacts for a duration of the rescue run based on the information received from the sensors.

5. The method according to claim 4, further comprising:
recording a malfunction of the elevator relating to a bypassed safety contact in non-volatile memory; and
prevent, based on the malfunction of the elevator recorded in the non-volatile memory, a run with the elevator after the rescue run has been performed.

6. The method according to claim 3, further comprising:
monitoring a presence of an object in a door opening of an elevator hoistway with the sensors measuring the operation of the elevator;
measuring, via the safety contact associated with a landing door, which door opening is open; and
bypassing the safety contact of the landing door that is open for a duration of the rescue run, if the door opening of the elevator hoistway is free.

7. The method according to claim 3, further comprising:
monitoring a presence of an object in a door opening of a car door with one or more sensors measuring the operation of the elevator
the safety contact of the car door that is open is bypassed for a duration of the rescue run, if the door opening of the car door is free.

8. The method according to claim 1, wherein:
selecting a drive direction of an elevator car based on information received from the sensors.

9. The method according to claim 1, wherein:
starting a run based on the information received from the sensors, for driving an elevator car with an elevator motor according to a speed reference to an exit floor.

10. The method according to claim 9, wherein:
starting a run for driving the elevator car by gravity to the exit floor, if a run in a direction of travel brought about by gravity is possible based on the information received from the sensors.

11. The method according to claim 10, wherein:
starting a run for driving the elevator car by gravity to the exit floor, if the run with the elevator motor fails.

12. An apparatus for performing a rescue run in an elevator system including an elevator car, an electrically operated hoisting machine configured to drive the elevator car, one or more electromagnetic machinery brakes; a brake controller configured to open the one or more electromagnetic machinery brakes by supplying current to the electromagnets of the machinery brakes, and to apply the electromagnetic machinery brakes to brake the electrically operated hoisting machine by disconnecting the current supply of electromagnets associated with the electromagnetic machinery brakes, a reserve power drive configured to supply electric power to the one or more electromagnetic machinery brakes during an electricity outage of the elevator, a drive unit configured to control movement of the elevator by supplying electric power from the main supply of the elevator to the electrically operated hoisting machine; wherein the apparatus comprises:
sensors measuring an operation of the elevator; and
an electronic safety controller configured to,
receive information about points being measured from the sensors,
read, from a non-volatile memory device, rescue run functions that are selectable to perform the rescue run,
select one or more of the rescue run functions based on information received from the sensors, and
perform the rescue run including the selected one or more rescue run functions.

13. The apparatus according to claim 12, wherein the electronic safety controller comprises:
two safety outputs controllable independently of each other, the two safety outputs including,
a first safety output connected to,
the drive unit such that the first safety output is configured to disconnect the current supply from the main supply of the elevator to the electrically operated hoisting machine, and
a brake controller such that the first safety output is configured to disconnect the current supply from the main supply of the elevator to the electromagnets of the one or more machinery brakes, and a second safety output connected to a brake controller, the second safety output configured to disconnect the current supply from the reserve power drive to the electromagnets of the one or more electromagnetic machinery brakes.

14. The apparatus according to claim 12, wherein the electronic safety controller is configured to, select one or more of the rescue run functions based on the information received from the sensors, and form a control command for performing the rescue run, including the selected one or more rescue run functions.

15. The apparatus according to claim 12, wherein the electronic safety controller is configured to, receive information during the rescue run from one or more sensors measuring the operation of the elevator, and interrupt the rescue run if the measured operation of the elevator differs from that desired.

16. The apparatus according to claim 14, wherein the apparatus comprises:

an elevator control unit configured to form a speed reference of the elevator car; and wherein the electronic safety controller is configured to form, based on the information received from the sensors, a control command for driving the elevator car with an elevator motor according to the speed reference to an exit floor.

17. The apparatus according to claim 14, wherein the electronic safety controller is configured to form a control command for driving the elevator car by gravity to an exit floor, if a run in a direction of travel brought about by gravity is possible based on the information received from the sensors.

18. The apparatus according to claim 17, wherein the electronic safety controller is configured to form the control command for driving the elevator car by gravity to the exit floor, if the run with an elevator motor according to a speed reference has failed.

19. The apparatus according to claim 12, wherein the sensors measuring the operation of the elevator comprise one or more safety contacts and/or a series circuit of the one or more safety contacts.

20. The apparatus according to claim 19, wherein the electronic safety controller is configured to bypass the one or more safety contacts for a duration of the rescue run on based on information received from the sensors.

21. The apparatus according to claim 20, wherein the electronic safety controller is configured to, record in non-volatile memory a malfunction of the elevator relating to a bypassed safety contact, and prevent, based on the malfunction of the elevator recorded in non-volatile memory, a run with the elevator after the rescue run has been performed.

22. The apparatus according to claim 12, wherein the electronic safety controller is configured to, monitor with one or more sensors measuring the operation of the elevator a presence of an object in a door opening of an elevator hoistway, the one or more safety contacts associated with a landing door measuring which door opening is open, and also bypass for a duration of the rescue run the one or more safety contacts of the landing door that is open, if the door opening of the elevator hoistway is free.

23. The apparatus according to claim 12, wherein the electronic safety controller is configured to measure with one or more sensors measuring the operation of the elevator a presence of an object in an open door opening of a car door, and bypass, for a duration of the rescue run, one or more safety contacts of the car door that is open, if the door opening of the car door is free.

24. The apparatus according to claim 12, wherein the electronic safety controller is configured to select a drive direction of the elevator car based on information received from the sensors.

* * * * *